US009220357B1

(12) United States Patent
Raggs

(10) Patent No.: US 9,220,357 B1
(45) Date of Patent: Dec. 29, 2015

(54) SYSTEM FOR SUPPORTING DISCRETE ARTICLES AT A VERTICALLY EXTENDING SURFACE

(71) Applicant: James Raggs, Gary, IN (US)

(72) Inventor: James Raggs, Gary, IN (US)

( * ) Notice: Subject to any disclaimer, the term of this patent is extended or adjusted under 35 U.S.C. 154(b) by 0 days.

(21) Appl. No.: 14/690,606

(22) Filed: Apr. 20, 2015

(51) Int. Cl.
*A47F 5/10* (2006.01)
*A47F 5/14* (2006.01)
*A47F 13/00* (2006.01)

(52) U.S. Cl.
CPC . *A47F 5/106* (2013.01); *A47F 5/10* (2013.01); *A47F 5/14* (2013.01); *A47F 13/00* (2013.01)

(58) Field of Classification Search
CPC .... A47B 96/16; A47B 88/0485; A47B 46/00; D06F 57/12; A47G 25/06; A47G 25/746; A47G 25/0685; A47F 5/106; A47F 5/10; A47F 5/14; A47F 13/00
USPC ..... 211/96, 168, 119.01
See application file for complete search history.

(56) References Cited

U.S. PATENT DOCUMENTS

| | | | | |
|---|---|---|---|---|
| 359,022 | A | 3/1887 | Marsh | |
| 1,259,532 | A | 3/1918 | Leach | |
| 1,973,974 | A | 9/1934 | Campbell | |
| 2,345,745 | A | 4/1944 | Goldbert | |
| 2,598,502 | A * | 5/1952 | Butler | 211/101 |
| 2,633,998 | A | 4/1953 | Derman | |
| 2,975,907 | A | 3/1961 | Hirsch | |
| 4,789,069 | A * | 12/1988 | Baus | 211/105.3 |
| 5,236,095 | A * | 8/1993 | Krizka | 211/96 |
| 6,196,398 | B1 * | 3/2001 | Lowe | 211/96 |
| 6,206,210 | B1 * | 3/2001 | Reed | 211/96 |
| 6,681,940 | B1 | 1/2004 | Cash et al. | |
| 6,712,228 | B2 | 3/2004 | Lowe | |
| 6,722,511 | B1 * | 4/2004 | Lowe | 211/119.004 |
| 8,376,155 | B1 * | 2/2013 | Olko et al. | 211/169 |
| 8,905,248 | B1 | 12/2014 | Wolski | |
| 8,950,836 | B2 * | 2/2015 | Kim et al. | 312/405 |
| 2009/0051256 | A1 * | 2/2009 | Compagnucci | 312/322 |
| 2010/0270246 | A1 * | 10/2010 | Rodriguez | 211/34 |
| 2013/0264932 | A1 * | 10/2013 | Kim et al. | 312/404 |
| 2013/0278127 | A1 * | 10/2013 | Kim et al. | 312/404 |

FOREIGN PATENT DOCUMENTS

| | | | | |
|---|---|---|---|---|
| WO | WO 2006032641 A1 * | 3/2006 | | F25D 23/04 |

* cited by examiner

*Primary Examiner* — Patrick Hawn
(74) *Attorney, Agent, or Firm* — Wood, Phillips, Katz, Clark & Mortimer

(57) ABSTRACT

The combination of: a) a wall with a vertically extending surface; b) first and second vertically spaced elongate support arms mounted at the vertically extending surface so that their lengths extend generally horizontally, the first elongate support arm movable between first and second positions relative to the vertically extending surface; c) holding structure to releasably maintain the first elongate support arm in one of the first and second positions; and d) a first support accessory releasably operatively connected to the first elongate support arm.

21 Claims, 5 Drawing Sheets

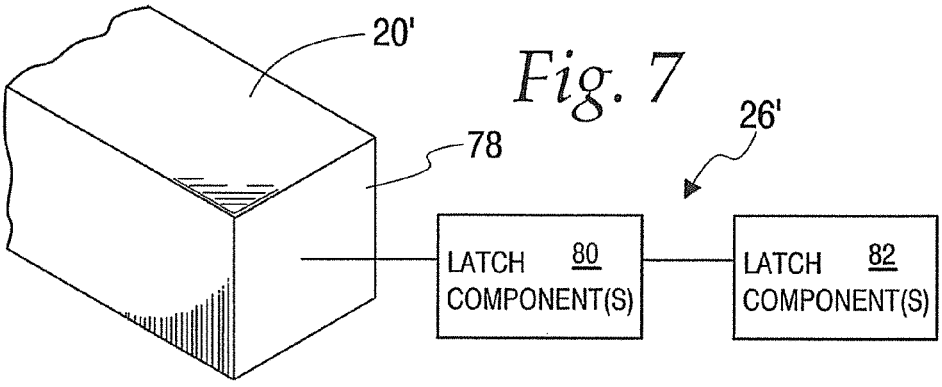
Fig. 7
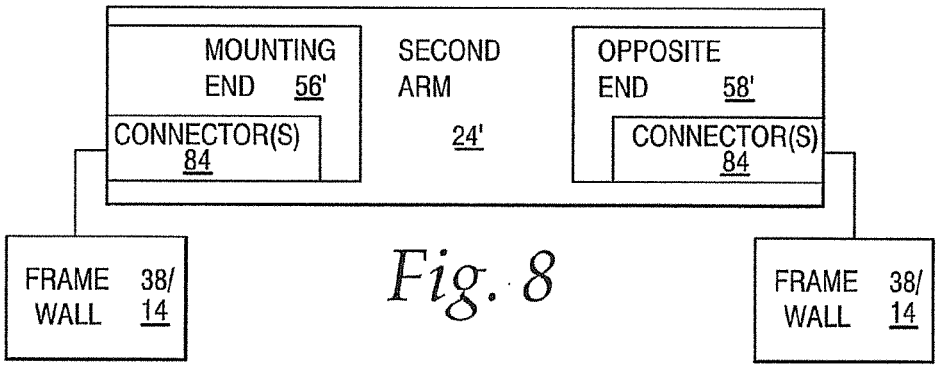
Fig. 8
Fig. 9
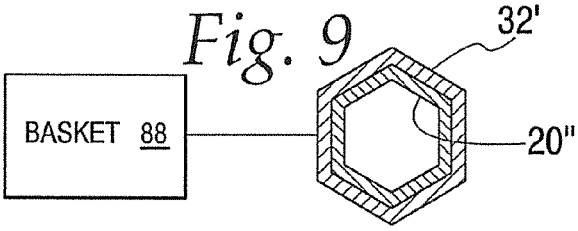
Fig. 11
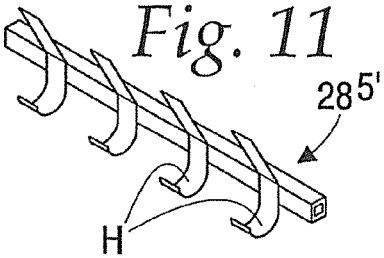
Fig. 12
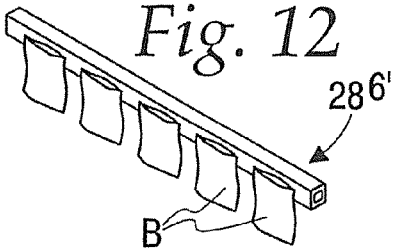

SYSTEM FOR SUPPORTING DISCRETE ARTICLES AT A VERTICALLY EXTENDING SURFACE

BACKGROUND OF THE INVENTION

1. Field of the Invention

This invention relates to supports for storing discrete articles and, more particularly, to a system for supporting such articles at a vertically extending surface, such as on a wall or door.

2. Background Art

Myriad different systems have been devised to support discrete articles, including apparel and other types, for storage at vertically extending surfaces such as on walls and doors—both entry and passage.

In a most basic form, support structures are fixedly attached to or at vertically extending surfaces at different heights to maximize use of space—both horizontally and vertically.

With this basic construction, there is little flexibility after the initial installation. Consequently, it is critical that all different structures that support articles be strategically positioned, ideally in anticipation of changing needs/requirements, since reconfiguration may involve potentially complicated and time consuming disassembly and reassembly steps. Disassembly may also cause structural or cosmetic damage at the wall surface that must be repaired.

This lack of system flexibility is particularly a problem with respect to growing children. Whereas an initial installation may be appropriate for a small child, as he/she grows, the height of certain support components may make them awkward to use. These designs may thus become impractical, or at best inconvenient, to use.

Over the years, consumers have been more demanding of versatility and flexibility when it comes to the above types of support systems. This has led to a multitude of modular designs which use a basic structural framework that allows different components, with different capabilities, to be repositioned and interchanged.

One common design uses multiple vertical channels that cooperatively support shelves, and the like. The channels are provided with slots to releasably accept brackets at different heights. The shelves, or other accessories, span at least a pair of the brackets that are suitably held in place.

In the event that shelves are utilized, repositioning thereof may involve separating the shelf component from the brackets and thereafter removing and repositioning the brackets. Repositioning the brackets and thereafter reconnecting the shelf component to the brackets may require a certain level of skill that typically is not in the possession of young children and many homeowners.

Further, the above type of system is generally designed for closets, and the like, and will typically incorporate a shelf width that is substantial and impractical for mounting on doors.

More significantly, most systems associated with doors are designed so that there is a minimal modification to the door structure, thereby precluding the use of fixed vertical channels common to many wall mounted designs.

Systems with a fixed configuration may be inherently difficult to handle and transport by reason of their length, volume, and/or weight.

Generally, door mounted systems have utilized components of relatively narrow width to facilitate their storage and handling and avoid interference with walls or other room structure when the associated door is opened. This has severely limited the desirability of such door mounted systems.

However, in spite of the limitations of existing systems for door applications, there still remains a desire to use the potentially significant amount of space available at the back of doors in homes and businesses. Effective utilization of this space has been significantly limited by existing designs.

SUMMARY OF THE INVENTION

In one form, the invention is directed to the combination of a wall with a vertically extending surface and first and second elongate support arms each having a length between a mounting end and an opposite end. The first and second elongate support arms are mounted at the vertically extending surface so that the lengths of the first and second elongate support arms extend generally horizontally. The first elongate support arm is at a first vertical location with respect to the vertically extending surface with the second elongate support arm at a second vertical location with respect to the vertically extending surface, either above or below the first vertical location. The first elongate support arm is configured to move between first and second positions relative to the second elongate support arm and the vertically extending surface. A part of the first elongate support arm is moved further away from the wall with the first elongate support arm in the second position than with the elongate support arm in the first position. Holding structure is configured to releasably maintain the first elongate support arm in one of the first and second positions. The combination further includes a first support accessory and structure cooperating between the first support accessory and the first elongate support arm to allow the first support accessory to be releasably operatively connected to the first elongate support arm.

In one form, the wall is a door that is mounted for movement selectively between closed and open positions to thereby block and expose an access opening.

In one form, the combination further includes a frame that is operatively positioned with respect to the wall and to which the first and second elongate support arms are connected.

In one form, the frame has first and second horizontally spaced and vertically extending channels. The mounting end of the first elongate arm is attached to the first channel and the holding structure is on the second channel.

In one form, the holding structure is in the form of a component at the opposite end of the first elongate support arm and a separate component that cooperate to releasably maintain the first elongate support arm in the first position.

In one form, the first elongate support arm is movable around an axis in changing between the first and second positions.

In one form, the first support accessory, the first elongate support arm, and the structure that cooperates between the first support accessory and first elongate support arm are configured so that the first elongate support arm must be in the second position to allow the first support accessory to be operatively connected to and released from the first elongate support arm.

In one form, the structure cooperating between the first elongate support arm and the first support accessory is configured so that the first support accessory is releasably operatively connected to the first elongate support arm by moving the first support accessory in a first direction from a separated position against and relative to the first elongate support arm.

In one form, the first direction is substantially parallel to the length of the first elongate support arm.

In one form, the structure cooperating between the first elongate support arm and the first support accessory is configured to make a telescoping connection.

In one form, the structure cooperating between the first elongate support arm and the first support accessory includes an elongate sleeve on one of the first elongate support arm first support accessory and a part that moves guidingly within the sleeve in a line generally parallel to the length of the first elongate support arm.

In one form, the first and second elongate support arms are part of a first assembly that is configured to be operatively mounted at the wall without modifying the wall.

In one form, the wall is a door. The first assembly is configured to be suspended from the door.

In one form, the first assembly has a hook-shaped hanger that wraps around an edge of the door.

In one form, the first elongate support arm has an upwardly facing edge over which articles can be draped. The first support accessory has an upwardly opening receptacle.

In one form, the structure cooperating between the first elongate support arm and the first support accessory is configured to key the first elongate support arm and first support accessory against turning around an axis that is substantially parallel to the length of the first elongate support arm.

In one form, the first and second channels are rigidly connected to each other to define a frame. The mounting end of the second elongate support arm is connected to the second channel. The second elongate support arm is configured to be moved between first and second positions relative to the vertically extending surface.

In one form, the first and second elongate support arms are movable around spaced axes in changing between their respective first and second positions.

In one form, the first elongate support arm in the second position projects in cantilever fashion away from the vertically extending surface.

In one form, the combination further includes a third elongate support arm mounted at the vertically extending surface and spaced vertically from each of the first and second elongate support arms.

BRIEF DESCRIPTION OF THE DRAWINGS

FIG. 7 is a partially schematic view as in FIG. 5 and showing a modified form of holding structure;

FIG. 8 is a schematic representation of structure cooperating between a fixed arm and the frame on the inventive support system;

FIG. 9 is a cross-sectional view of one form of connecting structure acting between an arm and support assembly on the inventive support system;

FIGS. 11 and 12 are perspective views of different types of support accessories.

DETAILED DESCRIPTION OF THE PREFERRED EMBODIMENT

Figure 1:
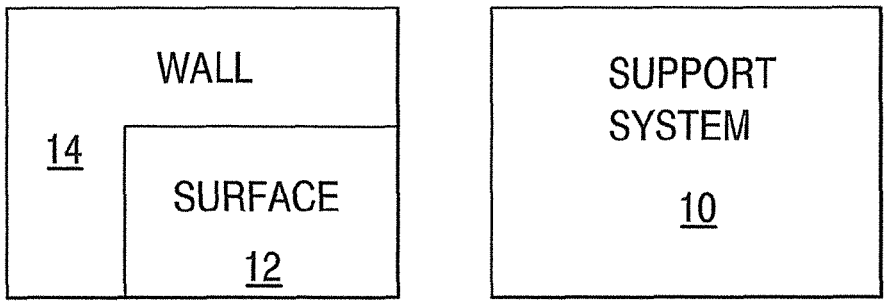
FIG. 1 is a schematic representation of a support system, according to the present invention, in relationship to a wall with a vertically extending surface.

In FIG. 1, one exemplary combination of components contemplated by the invention is shown in schematic form. More specifically, a support system at 10 is provided to be operatively positioned in relationship to a vertically extending surface 12 on a wall 14. The schematic showing of the components in FIG. 1 is intended to encompass virtually a limitless number of different variations of the inventive support system 10, as further described hereinbelow, and the structure with which it is associated. For example, the wall 14 may be a fixed wall or, and more preferably, part of a movable entry or passage door.

Figure 2:
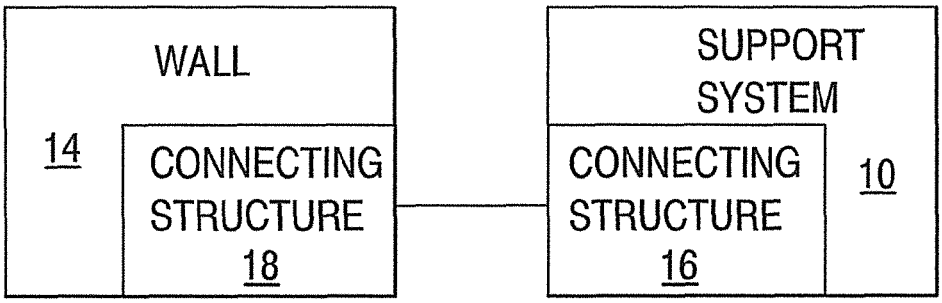
FIG. 2 is a view as in FIG. 1 showing an alternative support system configuration that is connected to the wall.

The support system 10 may be supported in operative relationship at the surface 12 in a freestanding manner. Alternatively, as shown in FIG. 2, connecting structure 16, 18 cooperates between the support system 10 and wall 14 to maintain the support system 10 in an operative relationship. The connecting structure may be a fixed connection, effected as by use of fasteners. Alternatively, the connecting structure 16, 18 might be configured so that the support system 10 is operatively positioned as through a hanger arrangement which does not require alteration of the wall 14 or associated surface 12.

Figure 3:
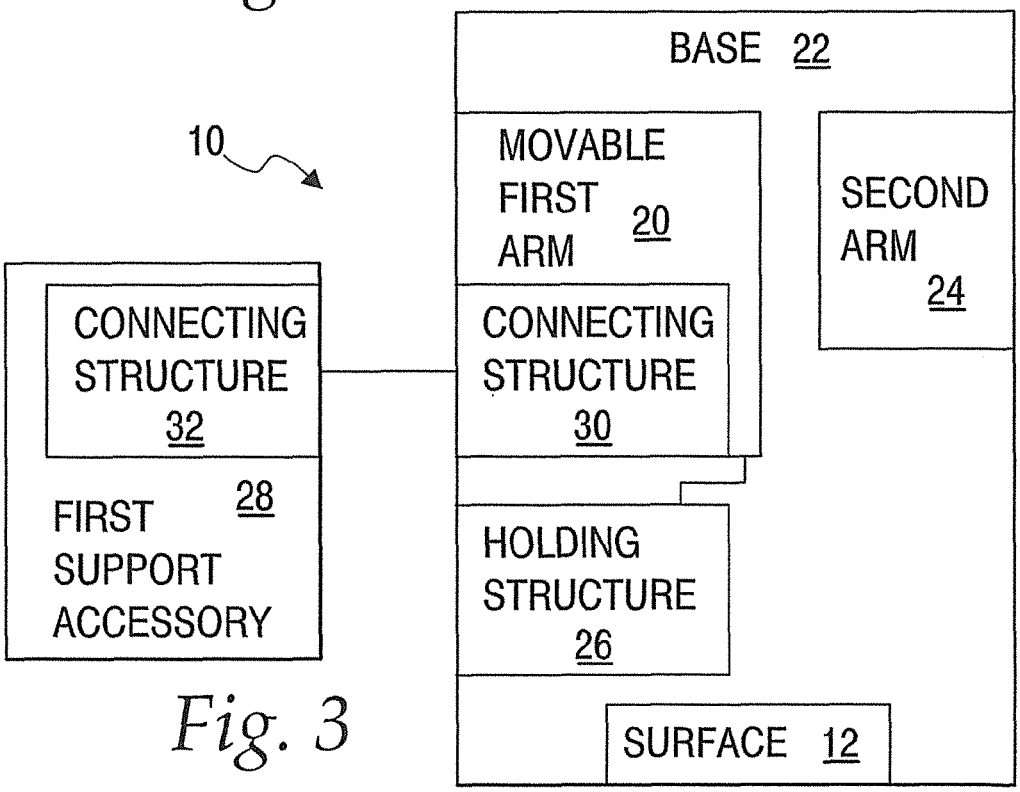
FIG. 3 is a schematic representation showing further details of the support system as shown in FIGS. 1 and 2.

As shown in greater detail in FIG. 3, the support system 10 consists of a first movable elongate support arm 20 that is mounted to a base 22 that may be the wall 14, a floor, other intermediate structure, or a combination thereof. The arm 20 has a length between a mounting end and an opposite end and is mounted at a first vertical location so as to be movable in a predetermined manner between first and second positions relative to a second elongate support arm 24 on the base 22 that is at a different vertical location than that of the first arm 20. The second arm 24 may be fixed or movable. The lengths of the first and second arms 20, 24 extend generally horizontally. A part of the first elongate support arm 20 is moved further away from the wall surface 12 with the arm 20 in the second position than with the arm 20 in the first position.

Holding structure 26 is configured to releasably maintain the first arm in one of the first and second positions.

The support system 10 further includes at least a first support accessory 28. Connecting structure 30, 32, respectively on the arm 20 and support accessory 28, cooperates to allow the first support accessory 28 to be releasably operatively connected to the arm 20.

As with the schematic showing in FIGS. 1 and 2, the schematic showing in FIG. 3 is intended to encompass virtually a limitless number of different component configurations and interactions consistent with the inventive concept described herein. The embodiments below are only exemplary in nature.

For example, each of the arms 20, 24 may, by itself, be configured to support discrete objects, such as apparel items or items used for any other purpose, that are commonly stored in businesses and residences. The first support accessory may have any form of an object supporting structure to facilitate storage of the particular type of object. For example, the supporting structure on the first support accessory 28 might be in the form of a basket, a hanger, a hook, a peg, a shelf, a drawer, a bag, etc. The connecting structure 32 is attached to the object supporting structure. It is further contemplated that additional support accessories with the same or different configurations may be interchangeably usable.

Further, the precise configuration of the holding structure 26 is not critical to the present invention. It is preferred that the holding structure 26 be releasable readily by a user to facilitate uncomplicated reconfiguration of the support system 10, generally as described hereinbelow.

Specific forms of the invention will now be described, with the understanding that these specific forms are exemplary in nature only and one of many variations contemplated within the schematic showing in FIGS. 1-3.

In FIGS. 4-9, the support system 10 is depicted operatively mounted upon the wall 14 that is a door—either entry or passage. The wall surface 12 is shown as on the back of the door 14. The door 14 is mounted to a frame 34 for movement selectively between closed and open positions, to thereby block and expose an access opening 36, typically surrounded by the frame 34.

Figure 4:
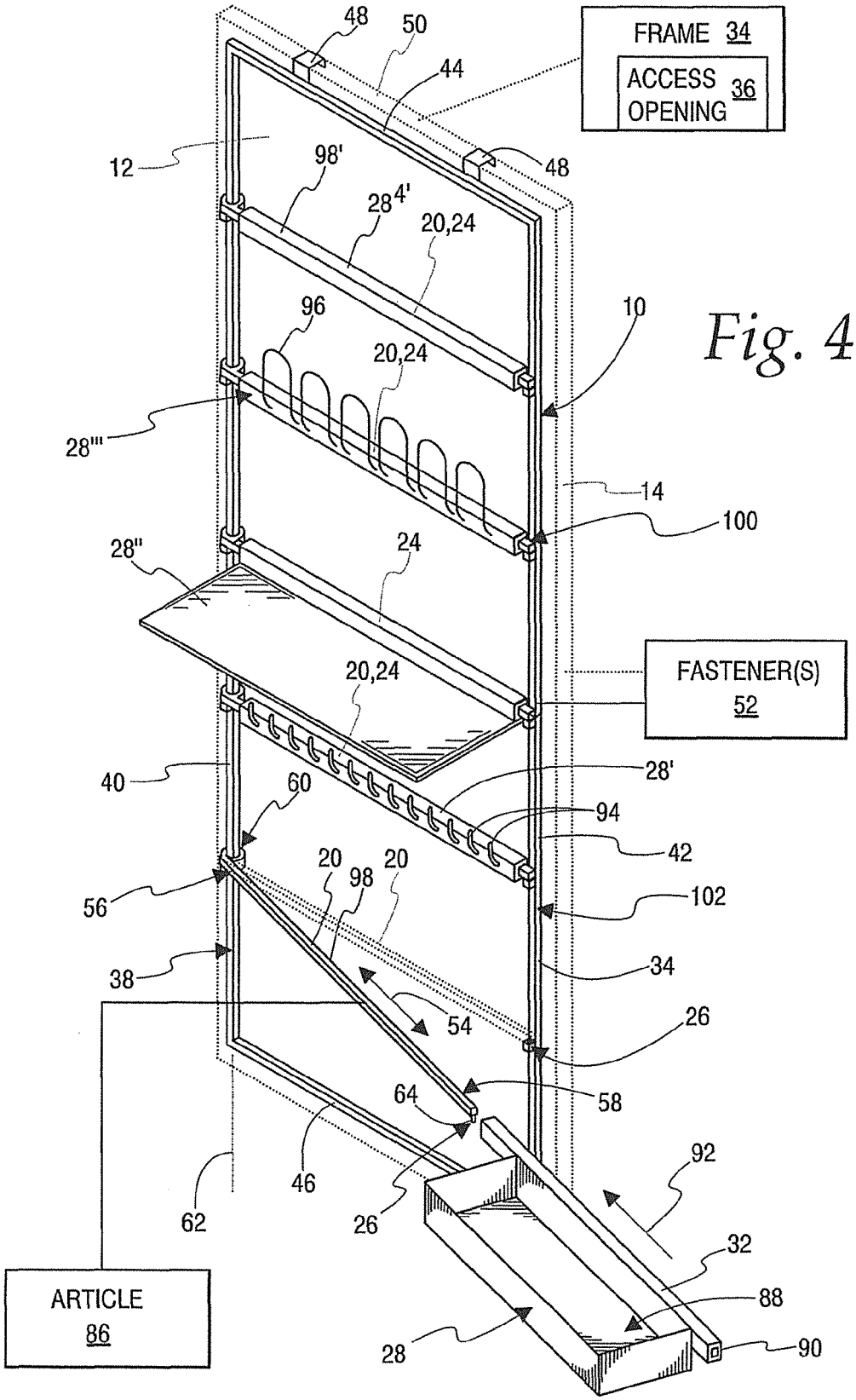
FIG. 4 is a perspective view of one specific form of the inventive support system, as shown in FIGS. 1-3.

The support system 10 consists of a frame 38 that is shown in FIG. 4 to be operatively positioned with respect to the door 14. The frame 38 consists of first and second horizontally spaced and vertically extending channels 40, 42. In this embodiment, the channels 40, 42 are connected at their upper and lower ends by horizontally extending members 44, 46, respectively. The channels 40, 42 and members 44, 46 together produce a generally rectangular frame shape that defines a first assembly that may be placed flushly against, in close proximity to, or a substantial distance from, the surface 12. The frame 38 may be supported by one or more hook-shaped hangers 48 that wrap around the upper edge 50 of the door 14. Alternatively, or in conjunction with the hangers 48, one or more fasteners 52 may be used to permanently or releasably fix the frame 38 to the door 14 with the same operatively positioned as in FIG. 4.

The first elongate support arm 20 has a length in the direction of the double-headed arrow 54 between a mounting end 56 and an opposite end 58. Through a connector assembly at 60, the mounting end 56 is connected to the channel 40 for pivoting movement about a vertically extending axis 62 between the aforementioned first and second positions, respectively shown in dotted and solid lines in FIG. 4. As seen, the majority of the length of the support arm 20 is moved further away from the door 14 with the support arm 20 in the second position than with the support arm 20 in the first position therefor. In the first position, the length of the support arm 20 extends substantially horizontally and generally parallel to the plane of the vertical wall surface 12.

At the end 58 of the support arm 20, the aforementioned holding structure at 26 is shown, with the understanding that suitable holding structure might be incorporated at the mounting end 56 or between the ends 56, 58. The depicted holding structure 26 consists of a depending peg 64 at the arm end 58 that is spring biased downwardly to an extended position as indicated by the arrow 66. The holding structure 26 further consists of a housing 68 on the channel 42 that defines a receptacle 70 for the peg 64 and an entry opening 72 into the receptacle 70. The receptacle 70 could alternatively be separate from the frame assembly. With the peg 64 extending through the opening 72 and into the receptacle 70, the first arm 20 is releasably maintained in its first position. Unseating of the peg 64 can be effected by urging the end 58 of the arm 20 upwardly slightly so that the peg 64 moves out from the housing receptacle 70. The peg 64 is initially seated by locating the peg 64 above the opening 72 with the arm end 58 urged slightly upwardly, preparatory to direction of the peg 64 therethrough. By spring loading the peg 64, the holding structure 26 may be configured to be operated by simply urging the arm end 58 towards and against the housing 68. A rounded end 74 will cam the peg 64 upwardly against the bias force under a predetermined force applied on the arm 20 in the direction of the arrow 76. Once the upwardly moved peg 64 aligns with the entry opening 72, it is biased to project downwardly through the entry opening 72 into the receptacle 70.

Alternatively, as shown with a modified form of arm 20' in FIG. 7, a free end 78 of the arm 20' may have one or more latch components 80 to cooperate with one or more latch components 82 associated with the frame 38 or the door 14 to define the holding structure 26'. The latch components 80, 82 may be any type of components that might be readily connected and released. With the construction shown in FIG. 7, the latch component 80 may reside entirely within the cross-sectional area of the arm 20', which has advantages in terms of connecting the first support accessory 28, as described hereinbelow.

In FIG. 4, the aforementioned second elongate support arm 24 has the same construction as the support arm 20 and is mounted in the same fashion as the support arm 20, in a vertically spaced relationship.

Alternatively, as shown in FIG. 8, a modified form of the second arm 24' may have mounting and opposite ends 56', 58' each fixedly connected to the frame 38 and/or wall 14 through appropriate connectors 84.

The precise number of elongate support arms 20, 24, 24' is not limited, with five such exemplary arms shown in FIG. 4. Any combination of movable and fixed arms 20, 24 is contemplated.

Further, the movable arms 20 can be connected to the frame 38 to pivot with respect to different channels 40, 42. For example, the mounting end 56 of one arm 20, 24 may be movably connected to the channel 40 with the mounting end 56 of another of the arms 20, 24 mounted to the channel 42. Further, the holding structure 26 may maintain the arms 20, 24 in different positions. For example, the arms 20, 24 may be releasably maintained in the first or second positions or a position in-between. When multiple arms 20, 24 are utilized, the arms 20, 24 may be maintained in different positions, each from the other.

As seen in FIG. 4, the arm 20 itself defines an elongate support between the channels 40, 42 upon which different types of articles 86 can be supported, as by being wrapped thereagainst or otherwise supported thereupon. For added versatility, the support accessories 28 can be utilized to change the capabilities of the arms 20, 24.

More specifically, as seen in FIG. 4, the exemplary, depicted, first support accessory 28 is in the form of an upwardly opening basket at 88 joined to the associated connecting structure 32. The connecting structure 32 is in the form of an elongate sleeve that makes a telescoping connection with the support arm 20 that defines the cooperating connecting structure 30. More specifically, the support arm 20 has a substantially constant cross-sectional configuration that will slide within a passageway 90 formed through the sleeve 32. With the cantilever mounted arm 20 in the second position therefor, shown in FIG. 4, the sleeve 32 can be selectively directed from an initially separated state lengthwise thereover: a) in the direction of the arrow 92 to operatively position the first support assembly 28; or b) oppositely thereto to selectively release the first support accessory 28 from the support arm 20.

The spring biased peg 64 will be cammed upwardly by the housing 68 as the end 58 of the support arm 20 is pressed thereagainst to allow it to align with, and be directed into, the passageway 90. The external surface of the arm 20 and passageway 90 are configured so that the arm 20 and sleeve 32 are guided, one against the other, to releasably operatively connect the first support accessory 28 to the arm 20 and separate the same therefrom. A reverse male/female part configuration is also contemplated.

By making the holding structure 26' utilizing latch components 80, 82 as shown in FIG. 7, the holding structure 26' does not interfere with the movement of the sleeve 32 onto and off of the cantilever-mounted arm 20'.

As seen in FIG. 4, the cross-sectional shapes of the arm 20 and passageway 90 are complementary and preferably non-round. Round shapes could be utilized, however. The shapes are ideally any complementary polygonal shape. As depicted, the polygonal shape is a square shape, although this is only exemplary in form. With the matching shape, the sleeve 32 is keyed to the arm 20 so that the sleeve 32 has a controlled or fixed angular orientation relative to the arm 20 with the first support assembly 28 operatively positioned.

In an alternative form, as shown in FIG. 9, the sleeve 32' has an hexagonal shape with the arm 20" having a matching configuration. With this arrangement, multiple angular orientations of the sleeve 32' and associated basket 88 relative to the arm 20" can be selected and maintained. For example, it may be desirable to have the basket 88 tipped at different angles for different types of article storage.

The basket 88 is exemplary of one form of the first support assembly 28. As noted above, there is virtually no limit to the number of different forms that may be selected for the support accessory. For example, in FIG. 4, one of the support accessories 28' has a series of hooks 94, as for supporting ties.

Another support accessory 28" shown in FIG. 4 is in the form of a horizontal shelf.

A still further form of support assembly 28''' in FIG. 4 has inverted U-shaped components 96, as to support hats.

A still further form of support assembly in FIG. 4 is shown at $28^{4'}$ to be simply a sleeve that enlarges the exposed surface compared to the surrounding arm 20. The arm 20, by itself, has an edge 98 over which articles can be draped. The support assembly $28^{4'}$ defines a wider support edge 98' for draping of articles thereover.

In FIGS. 11 and 12, still further forms of support assemblies are shown at $28^{5'}$ and $28^{6'}$, respectively. The former incorporates hooks H, as for coats, with the latter incorporating reconfigurable bags B.

Accordingly, with the above-described described construction, a user can simply reconfigure the support system 10 by changing the location of the various support assemblies 28, 28', 28", 28''', $28^{4'}$, $28^{5'}$, $28^{6'}$ and/or by using other types of support assemblies and configurations not depicted. For example, if one wished to put the hat support accessory 28''' at the top of the frame 38, he/she would simply release the holding structure 26 at the ends of the arms 20, 24, on which the support assemblies 28''', $28^{4'}$ are operatively mounted, and pivot the arms 20, 24 to their respective second positions. The support assemblies 28''', $28^{4'}$ can then be slid off of their respective arms 20, 24, vertically relocated, and slid back on the arms 20, 24 at the different vertical locations.

While the channels 40, 42 are united through the members 44, 46 to make a unitary frame assembly 38, the invention contemplates that the channels 40, 42 might be used without interconnection. Further, there is no requirement that the channels 40, 42 be used at all. Any structure that would allow the arms 20, 24 to be mounted as described is contemplated.

Figure 6:
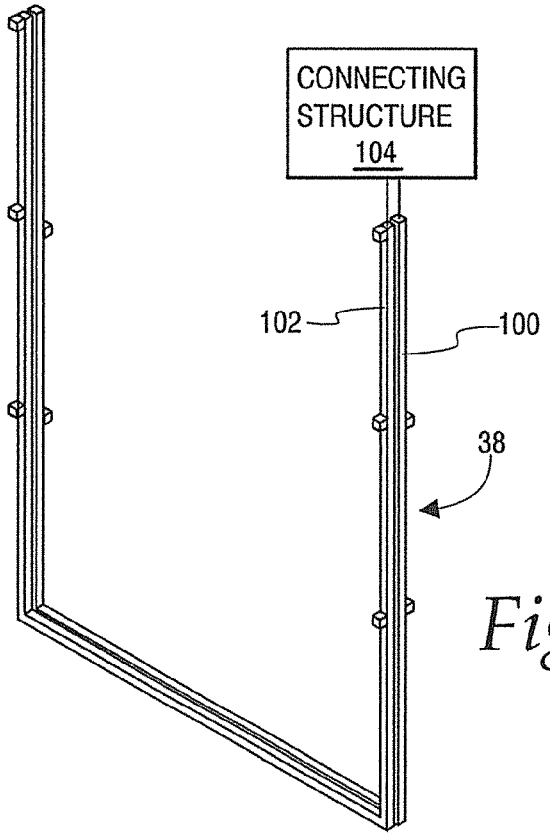
FIG. 6 is an enlarged, perspective view of the frame as shown in FIGS. 4 and 5 in a collapsed/storage state.

As shown in FIGS. 4 and 6, the frame 38 has separate, joined parts 100, 102 that can be moved relative to each other to break the frame 38 down into a collapsed, storage state, as shown in FIG. 6. In this state, the frame 38 can be more conveniently handled and shipped. The connection of the parts 100, 102 may be effected through any type of structure, as shown schematically at 104 in FIG. 6. The connecting structure 104 may be in the form of a hinge, telescopingly connected parts, etc. Alternatively, the parts 100, 102 may remain separate and become united only by integration of the same into the wall 14.

It is possible with the structures shown in FIGS. 4 and 6 to make two identical parts 100, 102 that, once joined, produce opposite hinge locations for the associated arms 20, 24.

Figure 10:
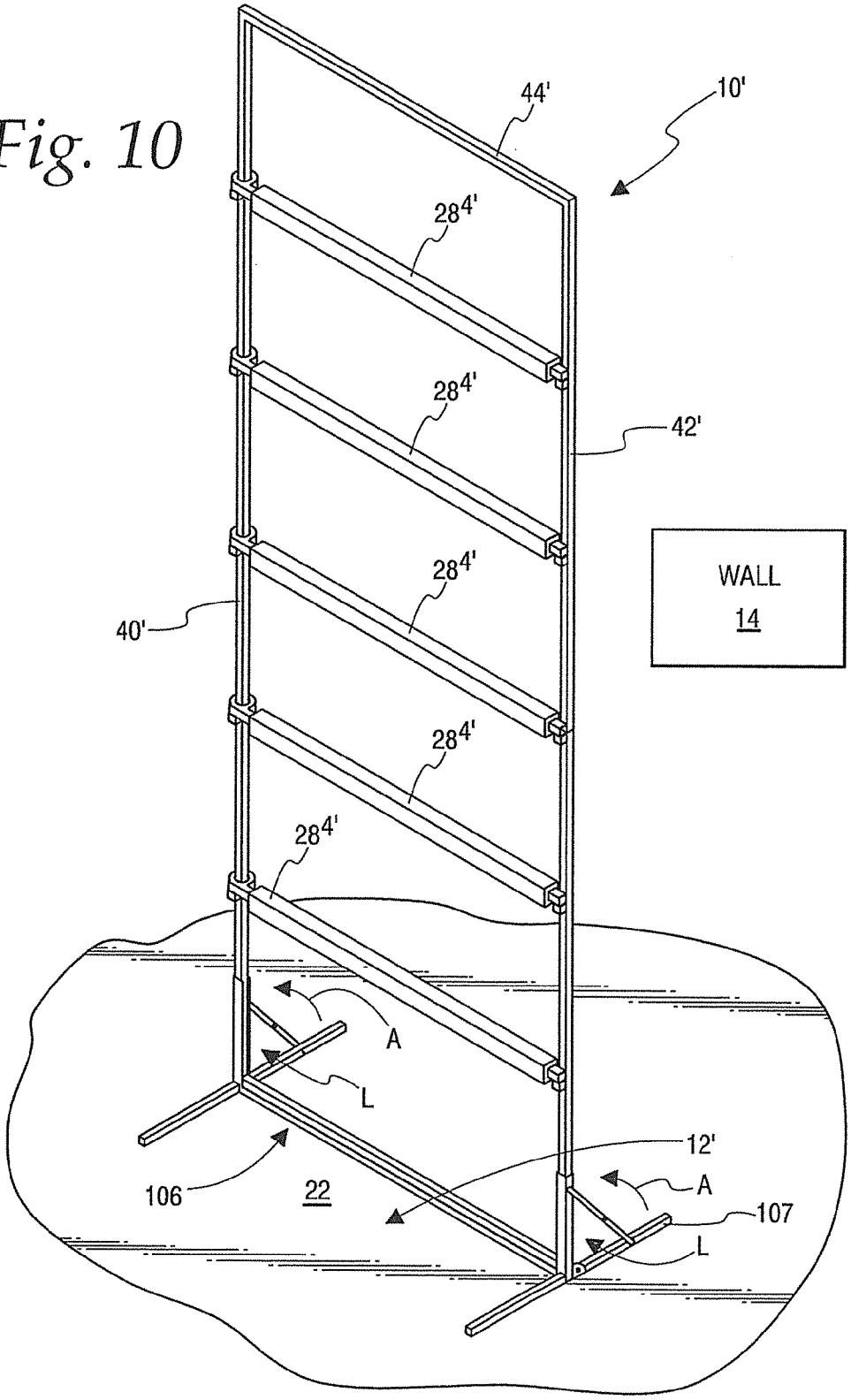
FIG. 10 is a view as in FIG. 4 of a modified form of support system, according to the invention.

A further modified form of support system is shown at 10' in FIG. 10. The support system 10' has corresponding channels 40', 42' joined by an upper member 44'. The channels 40', 42' are interconnected by a stand 106 at their bottom ends. The stand 106 is configured to support the system 10' upon the base 22, which may have an upwardly facing surface 12' in the vicinity of a vertically extending wall 14. For purposes of simplicity, no detail of the support accessories on the support system 10' is shown. Each support accessory is shown as the same exemplary support accessory $28^{4'}$ in FIG. 4, with it understood that any one support accessory, or combination of the support accessories, might be utilized. The basic operation of the support system 10' is otherwise the same as that described for the support system 10, above.

Optionally, spaced legs L on the stand 106 may be joined through linkages L that allow them to be folded upwardly in the direction of the arrows A so that the system 10' can be moved closer to the wall 14 without interference from the legs L.

Figure 5:
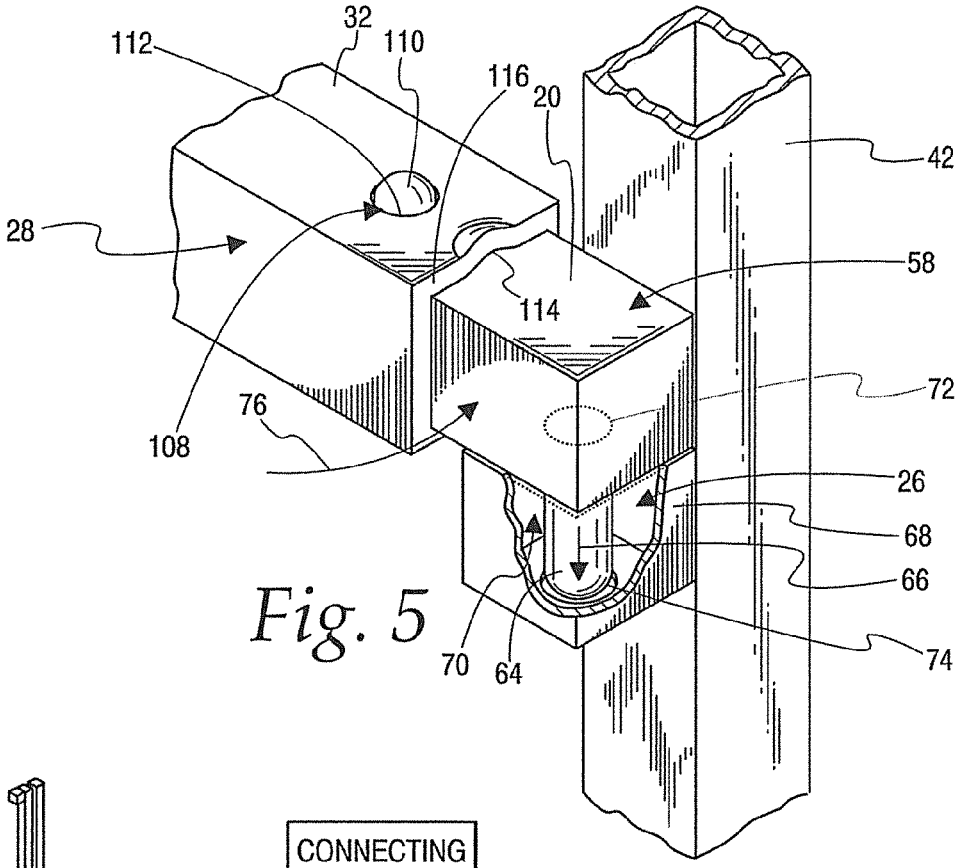
FIG. 5 is an enlarged, fragmentary, perspective view of holding structure with components cooperating between a movable arm with a support accessory and a supporting frame.

In FIG. 5, a detent arrangement is shown at 108 to consistently maintain the exemplary support accessory 28 in a desired position lengthwise relative to the arm 20. A convex male component 110 on the arm 20 is spring biased upwardly and, as depicted, projects into and slightly through a complementary opening 112 in the sleeve 32. Through this arrangement, the sleeve 32 can be consistently located lengthwise relative to the arm 20.

The sleeve 32 has a funnel-shaped entry opening 114 defined by a deformation at the sleeve end 116. This avoids hang-up of the component 110 as the component 110 moves to against the sleeve end 116.

The individual support accessories may have any desired length compared to that of the associated arm 20, 24. For example, the support accessory may span substantially the full dimension between the channels 40, 42. Alternatively, shorter support accessories might be utilized. The shorter support accessories might be held in place with a detent arrangement 108, or may be used without the same. With the shorter support accessory configuration, several support accessories with the same or different configurations may be mounted upon the same support arm 20.

The foregoing disclosure of specific embodiments is intended to be illustrative of the broad concepts comprehended by the invention.

The invention claimed is:

1. In combination:

a wall with a vertically extending surface;

a plurality of elongate support arms including first and second elongate support arms, each of the plurality of elongate support arms having a length between a mounting end and an opposite end, each of the support arms mounted at the vertically extending surface so that the lengths of the support arms extend generally horizontally, the first elongate support arm at a first vertical location with respect to the vertically extending surface with the second elongate support arm at a second vertical location with respect to the vertically extending surface either above or below the first vertical location, each of the first and second elongate support arms configured to move between first and second positions in a predetermined manner relative to the other of the first and second elongate support arms and the vertically extending surface, a part of each of the first and second elongate support arms moved further away from the wall with the first and second elongate support arms in their second position than with the first and second elongate support arms in their first position;

holding structure configured to releasably maintain each of the first and second elongate support arms in one of the first and second positions;

a first support accessory comprising a first object supporting structure and a first connecting structure joined to the first object supporting structure;

connecting structure on the first elongate support arm that cooperates with the first connecting structure on the first support accessory to allow the first support accessory initially in a separated state to be releasably operatively connected to the first elongate support arm with the first elongate support arm in its second position by relatively moving the first support accessory and the first connecting structure against and relative to the connecting structure on the first elongate support arm along a line substantially parallel to the length of the first elongate support arm;

one of the connecting structure on the first elongate support arm and first connecting structure comprising a sleeve within which a part of the other of the connecting structure on the first elongate support arm and first connecting structure is guided as the first support accessory moves along the line;

a second support accessory comprising a second object supporting structure and a second connecting structure joined to the second object supporting structure; and connecting structure on the second elongate support arm that cooperates with the second connecting structure on the second support accessory to allow the second support accessory initially in a separated state to be operatively connected to the second elongate support arm with the second elongate support arm in its second position by relatively moving the second support accessory and the second connecting structure relative to the connecting structure on the second elongate support arm along a line substantially parallel to the length of the second elongate support arm.

2. The combination of claim 1 wherein the wall is defined on a door that is mounted for movement selectively between closed and open positions to thereby block and expose an access opening.

3. The combination according to claim 1 further comprising a frame that is operatively positioned with respect to the wall and to which the first and second elongate support arms are connected.

4. The combination according to claim 3 wherein the frame comprises first and second horizontally spaced and vertically extending channels, the mounting end of the first elongate arm is attached to the first channel and the holding structure is on the second channel.

5. The combination according to claim 4 wherein the holding structure comprises a component at the opposite end of the first elongate support arm and another component that cooperate to releasably maintain the first elongate support arm in the first position.

6. The combination according to claim 1 wherein the first elongate support arm is movable around an axis in changing between the first and second positions.

7. The combination according to claim 1 wherein the first support accessory and first elongate support arm are configured so that the first elongate support arm must be in the second position to allow the first support accessory to be operatively connected to and released from the first elongate support arm.

8. The combination according to claim 7 wherein the first connecting structure is in the form of a sleeve with a passageway into which a part of the first elongate support arm extends with the first support accessory operatively connected to the first elongate support arm.

9. The combination according to claim 8 wherein the sleeve extends over a majority of the length of the first elongate support arm.

10. The combination according to claim 8 wherein the connecting structure on the first elongate support arm and the first connecting structure are configured to make a telescoping connection.

11. The combination according to claim 1 wherein the first and second elongate support arms are part of a first assembly that is configured to be operatively mounted at the wall without modifying the wall.

12. The combination according to claim 11 wherein the wall is defined on a door and the first assembly is configured to be suspended from the door.

13. The combination according to claim 11 wherein the first assembly comprises a hook-shaped hanger that wraps around an edge of the door.

14. The combination according to claim 1 wherein the first elongate support arm has an upwardly facing edge over which articles can be draped and the first support accessory defines an upwardly opening receptacle.

15. The combination according to claim 10 wherein the connecting structure on the first elongate support arm and the first connecting structure are configured to key the first elongate support arm and first support accessory against turning around an axis that is substantially parallel to the length of the first elongate support arm.

16. The combination according to claim 4 wherein the first and second channels are rigidly connected to each other to define a frame, the mounting end of the second elongate support arm is connected to the second channel, and the second elongate support arm is configured to be moved between first and second positions relative to the vertically extending surface.

17. The combination according to claim 16 wherein the first and second elongate support arms are movable around spaced axes in changing between their respective first and second positions.

18. The combination according to claim 1 wherein with the first elongate support arm in the second position, the first elongate support arm projects in cantilever fashion away from the vertically extending surface.

19. The combination according to claim 1 further comprising a third elongate support arm mounted at the vertically extending surface and spaced vertically from each of the first and second elongate support arms.

20. The combination according to claim 1 wherein the first and second support accessories are configured to be interchangeably operatively connected to the first elongate support arm.

21. The combination according to claim 20 wherein the first and second support accessories have a different configuration to store objects in different manners.

* * * * *